United States Patent [19]

Rieck

[11] 4,277,934

[45] Jul. 14, 1981

[54] CHECKREIN RELEASABLE LATCHING MECHANISM

[76] Inventor: Kenneth H. Rieck, 531 N. Knight Rd., Bay City, Mich. 48706

[21] Appl. No.: 22,524

[22] Filed: Mar. 21, 1979

[51] Int. Cl.[3] ..... B68B 5/00

[52] U.S. Cl. ..... 54/70; 403/325; 403/328; 403/DIG. 6

[58] Field of Search ..... 54/16, 17, 69, 70; 119/110, 111, 114, 115; 403/322, 325, 328, DIG. 6

[56] References Cited

U.S. PATENT DOCUMENTS

| | | | |
|---|---|---|---|
| 709,778 | 9/1902 | Ketteringham | 54/70 |
| 3,065,011 | 11/1962 | Pew | 403/328 |
| 3,693,484 | 9/1972 | Sanderson, Jr. | 403/328 |

FOREIGN PATENT DOCUMENTS

| | | | |
|---|---|---|---|
| 175064 | 4/1961 | Sweden | 403/325 |
| 482551 | 12/1975 | U.S.S.R. | 403/325 |

*Primary Examiner*—S. Leon Bashore
*Assistant Examiner*—Steve Alvo
*Attorney, Agent, or Firm*—Learman & McCulloch

[57] ABSTRACT

A releasable latching mechanism for a checkrein having a body fixed to a harness and in which is removably accommodated an anchor secured at one end to a checkrein. Locking balls are accommodated in openings formed in a wall of the body, the balls being of larger diameter than the thickness of the body wall. An operating sleeve is mounted on the body for sliding movements between positions in which the anchor member is latched and released. When the operating sleeve is in its anchor latching position the inner surface of the sleeve bears against the locking balls and forces them inwardly of the body so that portions of such balls project into an annular groove formed in the anchor member, thereby preventing separation of the anchor member from the body. When the operating sleeve is moved to its anchor releasing position, an annular recess formed in the inner surface of the sleeve confronts the balls enabling the anchor member to move the balls out of the anchor's annular groove, thereby freeing the anchor for separation from the body. An actuating member is connected to the operating sleeve and extends rearwardly therefrom to enable movement of the operating sleeve to its anchor releasing position at a distance remote from the mechanism.

2 Claims, 5 Drawing Figures

CHECKREIN RELEASABLE LATCHING MECHANISM

BACKGROUND OF THE INVENTION

For many years it has been conventional practice in the training and racing of a trotting or pacing horse to make use of a checkrein which, when in use, maintains the horse's head erect. Following completion of a race or training session the horse commonly is excited and nervous and often tosses his head with such force that he is apt to be injured if a checkrein remains in its operative condition. It is desirable, therefore, to release the checkrein as promptly as possible following completion of a race or a training exercise.

A checkrein of the kind presently in use is adapted to be secured to an upstanding and rearwardly inclined hook-like post mounted on a portion of the harness in the vicinity of the horse's withers. Although the driver of the horse is seated on a sulky quite close to the rear of the horse, it is not possible for the driver to remain in his seat and reach the anchor post to release the checkrein. With such a checkrein it is necessary for some other person to release the checkrein, or the driver must dismount the sulky and do it himself. In either case, considerable time may elapse between the completion of a race or training exercise and the release of the checkrein. In those instances in which the driver must dismount his sulky, he is exposed to considerable risk of being injured, particularly if the horse is spirited and excited.

The disadvantages referred to above may be overcome by the use of a checkrein mechanism which maintains the checkrein in its operative condition for the required period of time and which may be released by the horse's driver without necessitating his leaving his seat. Driver actuated checkrein release mechanisms have been proposed heretofore, for example, in U.S. Pat. Nos. 709,778 and 897,973, but known releasable latch mechanisms have had disadvantages associated with them. For instance, known devices rely for their operation primarily upon springs which can be overcome or rendered inoperative by an especially determined horse. Further, known constructions may be incapable of releasing a checkrein should they be actuated when the horse imposes tension on the checkrein by attempting to lower its head.

A principal object of the invention is to provide a releasable latch mechanism operable to secure a checkrein in its operative condition, which may be operated from a remote position by the horse's driver, and which overcomes the problems associated with mechanisms having a similar purpose.

BRIEF DESCRIPTION OF THE DRAWINGS

Objects and advantages of the invention, other than those referred to above, will become apparent from the following description when it is considered in conjuction with the appended claims and the accompanying drawings, wherein:

A checkrein construction according to the invention is adapted to be mounted on a block 1 fixed to a harness strap 2 that is adapted to encircle the body of a horse adjacent its withers.

Figure 4:
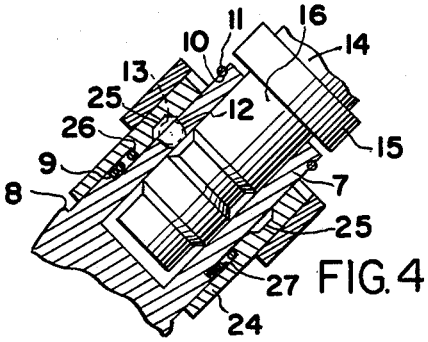
FIG. 4 is a view similar to FIG. 3, but illustrating the parts in adjusted, unlatched condition.

The checkrein latching mechanism comprises a body 3 having a mounting stud 4 that is adapted to pass through openings formed in the members 1 and 2 and receive a washer 5 and a lock nut 6. The body 3 is inclined at its upper end and terminates in an annular socket 7 having a pair of axially spaced shoulders 8 and 9 on its outer surface. At its free end the socket 7 has an external groove 10 therein for the removable accommodation of a C-shaped retainer 11. Between its ends the socket 7 is provided with three circumferentially spaced, radially extending openings 12 in each of which is loosely accommodated a locking ball 13. The innermost ends of the openings 12 are of smaller diameter than that of the balls, as is best shown in FIG. 4, so as to preclude movement of the balls wholly into the socket 7.

The latching mechanism also includes an anchor member 14 having a flange 15 between ends and terminating at one end in a cylindrical projection 16 having formed therein an annular groove 17. The groove preferably has upwardly diverging sidewalls 18. At its other end the body 14 is pivoted, by a pin 19, to a U-shaped retainer 20 having a cross bar 21 adapted to be accommodated in a loop 22 formed at one end of a checkrein 23. Although not shown in the drawings, it will be understood that the opposite end of the checkrein 23 is fastened to the bridle of a horse in the conventional manner.

Figure 5:
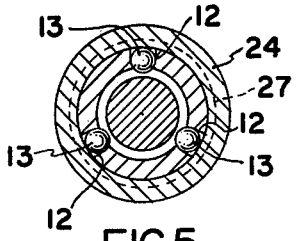
FIG. 5 is a sectional view taken on the line 5—5 of FIG. 3.

As is best shown in FIG. 5 each of the locking balls 13 has a diameter greater than the wall thickness of the socket 7. Consequently, whenever the periphery of a locking ball is flush with either the inner or outer surface of the wall of the socket 7, some portion of the ball will protrude beyond the opposite surface of the socket wall.

The diameter of the projection 16 of the anchor member is such that is snugly, but slidably, may be accomodated within the socket 7. The length of the projection 16 is such as to enable it to be received wholly within the socket 7 with the groove 17 at a level corresponding substantially to that of the locking balls 13. Preferably, the groove's walls 18 diverge so that their radially outer edges are spaced apart a distance somewhat greater than the diameter of the openings 12 so as to facilitate passage of the balls 13 into and out of the groove 17.

Means for operating the latching mechanism comprises a sleeve 24 slidably accommodated on the socket 7 between the first shoulder 8 and the retainer 11. The length of the sleeve 24, however, is less than the distance between the shoulder 8 and the retainer 11 so as to enable the sleeve to slide a limited distance longitudinally of the socket 7.

Figure 3:
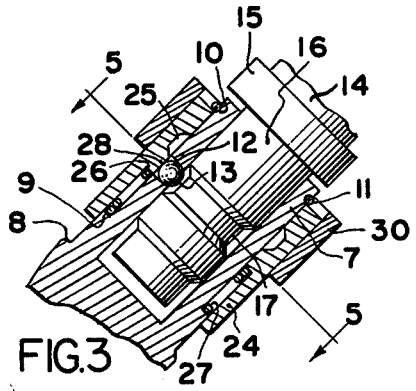
FIG. 3 is an enlarged, sectional view taken on the line 3—3 of FIG. 1 and illustrating the parts in latched condition.
Figure 2:
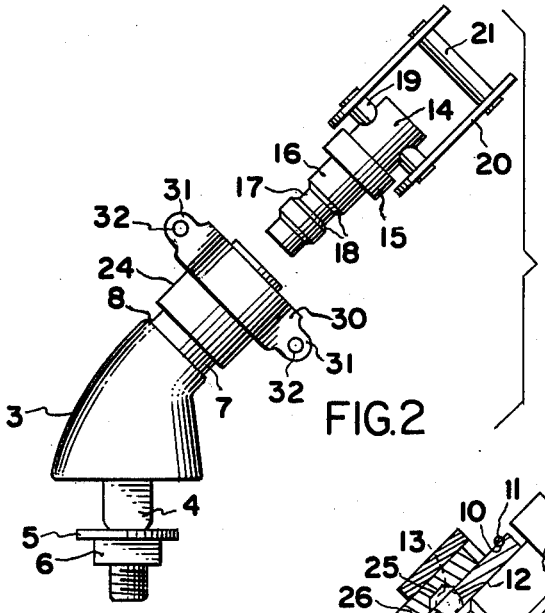
FIG. 2 is an exploded, side elevational view of the mechanism with the parts thereof being shown in disassociated condition.

The inner surface of the sleeve 24 has a major portion of its diameter corresponding substantially to that of the smallest diameter of the socket 7, but has an annular recess 25 therein having a configuration complementary to that of the groove 17 in the projection 16. Adjacent one end of the sleeve 24 its inner surface is counterbored to provide a shoulder 26 that is spaced from, but confronts the shoulder 9. Between the shoulders 9 and 26 is a compression spring 27 which constantly acts on the sleeve 24 and yieldably biases the latter toward and into engagement with the retainer 11, as is shown in FIG. 3. When in this position, a portion 28 of the inner surface of the sleeve 24 overlies the openings 12 in the socket 7 and the recess 25 occupies a position between the openings 12 and the retainer 11 and out of register with the openings. Thus, the outer peripheral surface of each of the balls 12 is substantially flush with the outer surface of the wall of the socket 7, whereas the inner periphery of each of the locking balls extends beyond the inner surface of the socket 7 and occupies the groove 17, thereby preventing withdrawal of the projection 16 from the socket 7.

Actuating means operable from a position remote from the latching mechanism is provided for shifting the sleeve 24 and comprises a fitting 30 that is fixed to the sleeve 24 and has a pair of ears 31 in each of which is an aperture 32. Through each aperture extends one end 33 of a strap or line 34 that may extend rearwardly of the horse and pass under its tail.

Figure 1:
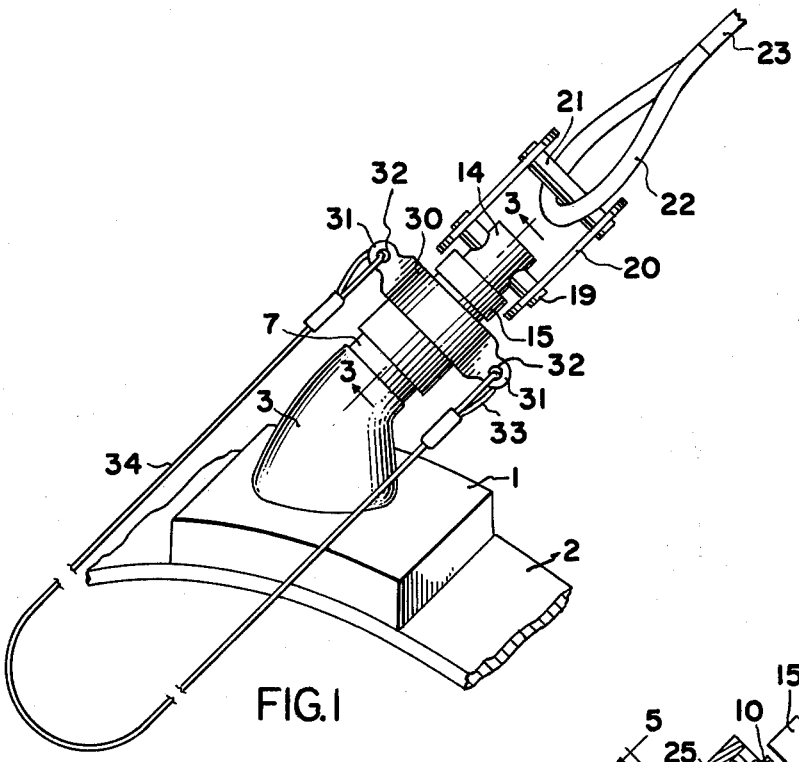
FIG. 1 is an isometric view illustrating a checkrein mechanism constructed in accordance with the invention.

The construction and arrangement of the mechanism, when in the condition shown in FIG. 1, are such that the sole application of a tensile force on the actuating line 34 to the left will cause corresponding movement of the sleeve 24, thereby enabling the recess 25 to move into register with the openings 12. If tension then is applied on the checkrein 23 by the horse, as will be the case following racing or exercising of the horse, the inclination of the innermost sidewall 18 of the groove 17 will cause the locking balls 13 to be projected outwardly and into the recess 25, whereupon the projection 16 is free to move out of the socket 7. The checkrein then is free and imposes no restraint on the head of the horse.

To reassemble the anchor member 14 with the body member 3, the sleeve 24 is slid to the position shown in FIG. 4 in which the recess 25 overlies the openings 12, whereupon the projection 16 is inserted into the socket 7. When the projection 16 has been slid into the scoket 7 a distance sufficient to enable the groove 17 to register with the openings 12, the sleeve 24 may be released, whereupon the spring 27 will move the sleeve toward the position shown in FIG. 3, thereby enabling the sleeve portion 28 to move the locking balls 13 into the groove 17 and retain the projection 16 within the socket 7.

When a sulky is harnessed to a horse, the driver of the sulky sits sufficiently near the rear of the horse to enable the line 34 to be reached by the driver, thereby enabling the driver to release the checkrein without dismounting his seat.

The disclosure is intended to be illustrative rather than definitive of the invention. The invention is defined in the claims.

I claim:

1. A releasable checkrein latching mechanism comprising a body member having a cylindrical socket therein; means for mounting said body member on a harness; an anchor member having at one end thereof a projection removably accommodated in said socket and having at its other end means for attachment to a checkrein, said socket being formed by an annular wall having a plurality of circumferentially spaced openings therein; a plurality of locking balls corresponding in number to the number of said openings and being loosely accommodated therein, each of said balls having a diameter greater than the thickness of said wall, said projection having an annular groove therein between its ends in a position to confront said balls when said projection is accommodated in said socket; an annular operating member encircling said body member and being slidable relative thereto between first and second positions, said operating member having an inner surface substantially flush with said projection and in engagement with said balls when said operating member is in said first position thereby causing portions of said balls to project into said annular groove, said operating member having an annular recess in its inner surface and confronting said balls when said operating member is in its second position thereby enabling said portions of said balls to be withdrawn from said annular groove; and flexible drive actuating means connected to said operating means for sliding said operating member from its said first position to its second position from a zone removed from said body member, said projection being removable from said socket and body member solely in response to movement of said operating member to said second position.

2. The mechanism according to claim 1 including yieldable means acting between said body member and said operating member for biasing the latter to said first position.

* * * * *